US006145838A

United States Patent [19]

White

[11] Patent Number: 6,145,838

[45] Date of Patent: Nov. 14, 2000

[54] LUMINESCENT PLAYING CARDS

[76] Inventor: Ian White, 15 Tabor Pl. #3, Brookline, Mass. 02445

[21] Appl. No.: 09/225,226

[22] Filed: Jan. 4, 1999

[51] Int. Cl.[7] ..... A63F 1/02

[52] U.S. Cl. ..... 273/295; 273/293; 273/DIG. 24; D21/378; D21/376

[58] Field of Search ..... 273/293, 295, 273/DIG. 24; D21/378, 376

[56] References Cited

U.S. PATENT DOCUMENTS

| | | | |
|---|---|---|---|
| 1,659,952 | 2/1928 | Hurley | 350/276 |
| 3,734,509 | 5/1973 | Glass et al. | 273/139 |
| 4,409,277 | 10/1983 | Michel | 428/156 |
| 4,681,324 | 7/1987 | Karabed et al. | 273/295 |
| 5,259,907 | 11/1993 | Soules et al. | 156/277 |
| 5,465,975 | 11/1995 | Shull et al. | 273/295 |

OTHER PUBLICATIONS

"Lightless Light", Scientific American, Philip H. Smith, pp. 324–327, Dec. 1940.

*Primary Examiner*—Benjamin H. Layno
*Attorney, Agent, or Firm*—Aquilino, Welsh & Flaxman

[57] ABSTRACT

A set of playing cards is disclosed including a plurality of cards, wherein each card includes distinct indicia printed thereon such that a first image is revealed under lighted conditions and a second image is revealed under non-lighted conditions.

10 Claims, 2 Drawing Sheets

LUMINESCENT PLAYING CARDS

BACKGROUND OF THE INVENTION

1. Field of the Invention

The invention relates to playing cards. More particularly, the invention relates to luminescent playing cards which project one image under lighted conditions and an alternate image when no light is present.

2. Description of the Prior Art

A conventional deck of playing cards includes fifty-two cards divided into four suits of thirteen cards each. In use, the cards are commonly distributed amongst a plurality of players, who then take some action in accordance with the rules for the game.

As is certainly well appreciated, most card games require that the players study their cards before taking action during the course of the game. Viewing the cards is generally not a problem, but may become a problem when players are required to play under non-ideal lighting conditions. For example, where players wish to play cards while camping or during a power failure, adequate light may not be available and the playing cards are not readily viewable by those playing the game. Similarly, players may wish to play card games in the dark as a novelty or change of pace.

No satisfactory remedy has yet been developed which allows individuals to play cards without light. The present invention provides such a remedy.

SUMMARY OF THE INVENTION

It is, therefore, an object of the present invention to provide a set of playing cards including a plurality of cards, wherein each card includes distinct indicia printed thereon such that a first image is revealed under lighted conditions and a second image is revealed under non-lighted conditions.

It is also an object of the present invention to provide a set of playing cards wherein the first image is imprinted with conventional ink.

It is another object of the present invention to provide a set of playing cards wherein the second image is imprinted with luminescent ink.

It is a further object of the present invention to provide a set of playing cards wherein the second image is imprinted with phosporescent ink.

It is also an object of the present invention to provide a set of playing cards wherein the set of playing cards includes fifty-two cards.

It is another object of the present invention to provide a set of playing cards wherein the second image is the inverse of the first image.

It is a further object of the present invention to provide a set of playing cards wherein each card includes a front face imprinted with a standard design found upon each of the cards found in the set and a second face upon which the first image and the second image are imprinted.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
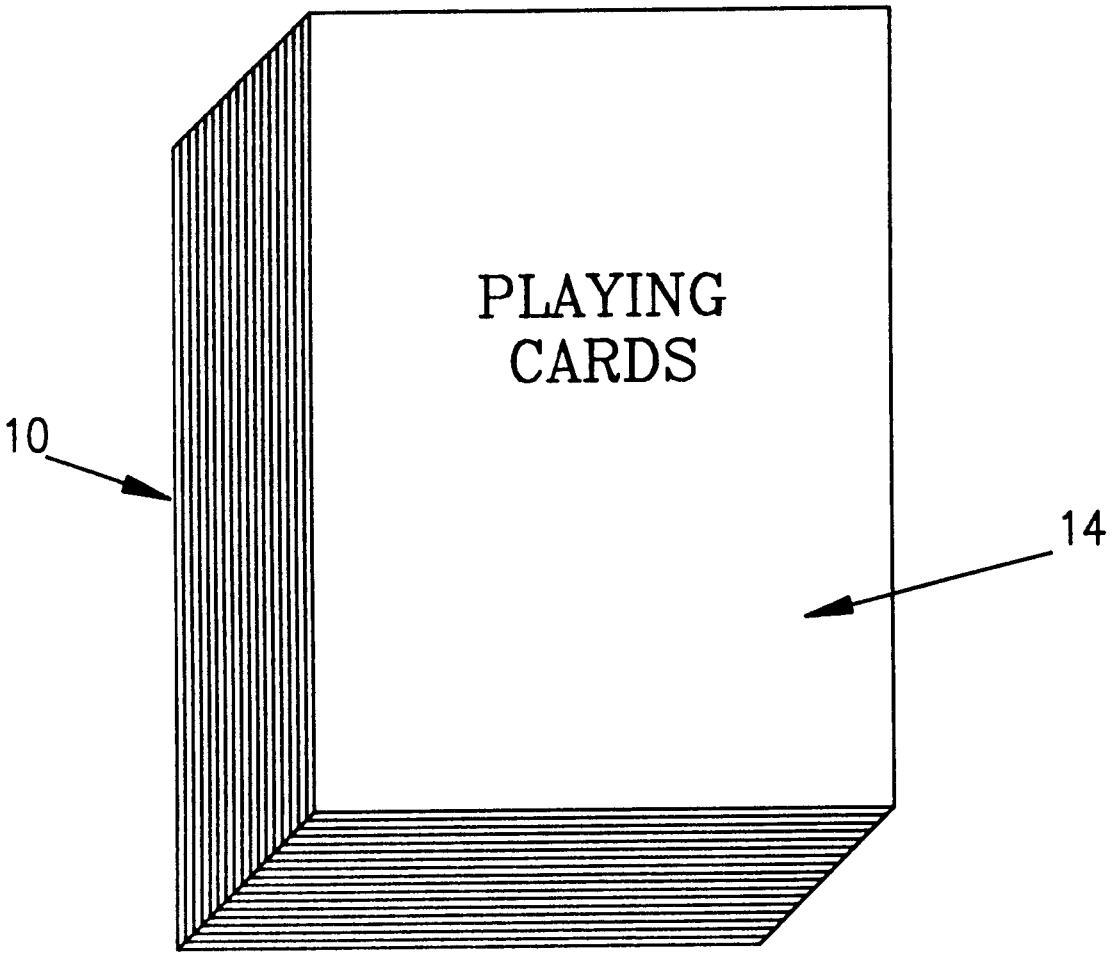
FIG. 1 is a perspective view of a deck of cards in accordance with the preferred embodiment of the present invention.

With reference to FIG. 1, a set of playing cards 10 is disclosed. In accordance with the preferred embodiment of the present invention, the playing cards 10 resemble a traditional fifty-two card deck of playing cards used in playing poker, bridge and other card games. Those of ordinary skill in the art will certainly appreciate that aesthetic variations may be made in the design of cards without departing from the spirit of the present invention. In addition, the present invention may be applied to sets of playing cards used in other card games without departing from the spirit of the present invention.

The term "luminescent ink" is used throughout the body of this specification to denote inks which will provide an image under dark conditions. As such, the term "luminescent ink" is considered to include all traditional luminscent inks, phosphorescent inks and similar inks which display an image under dark conditions.

Figure 2B:
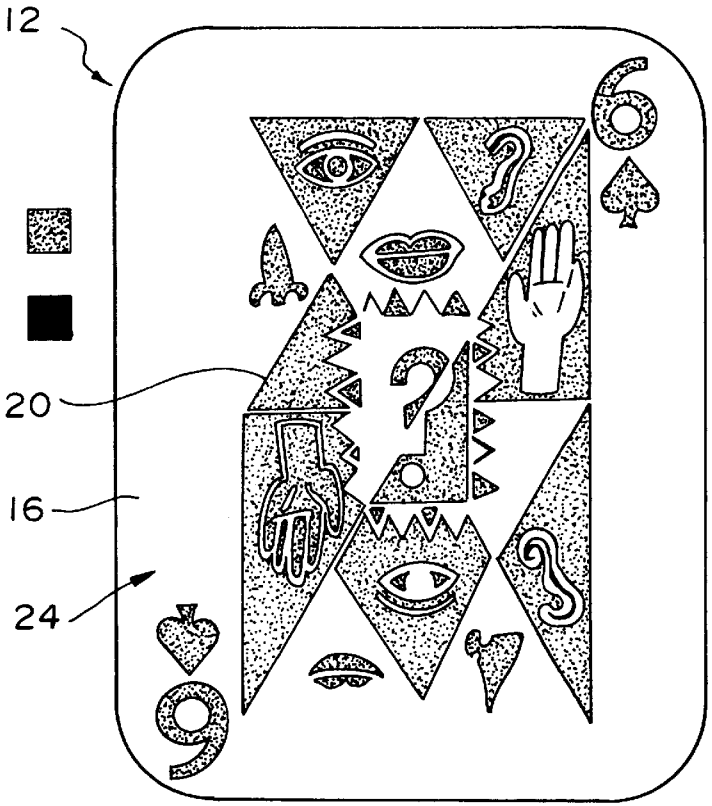
FIG. 2*b* is a top view of the six of spades under non-lighted conditions.
Figure 2A:
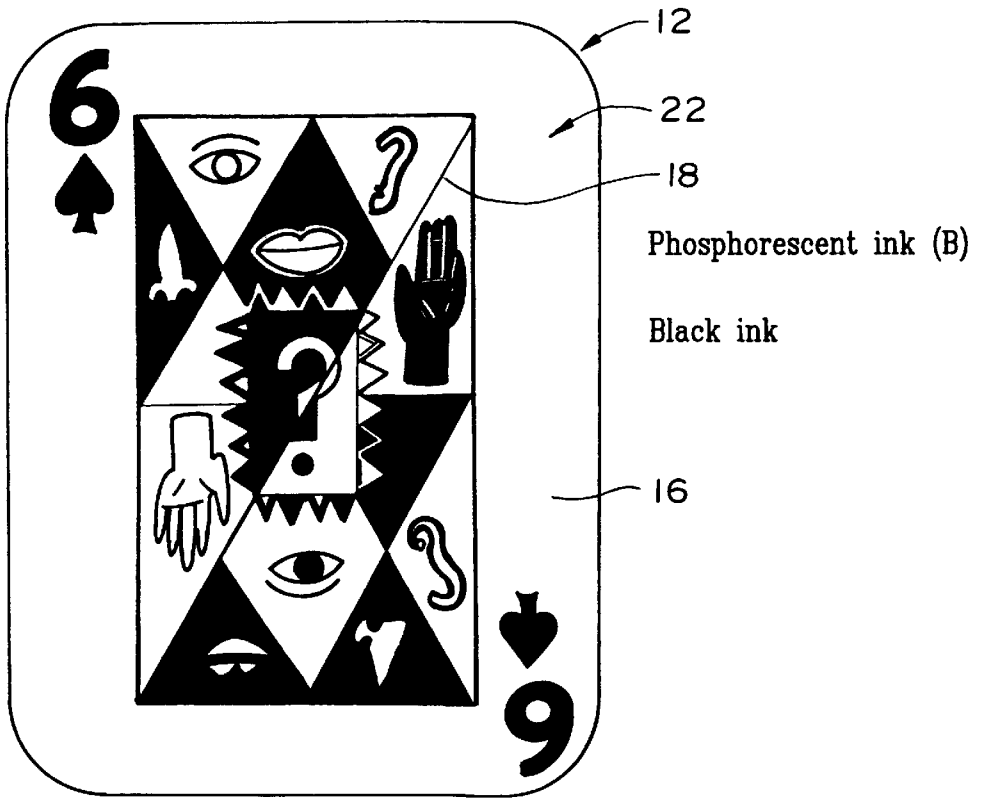
FIG. 2*a* is a top view of the six of spades under lighted conditions.

The playing cards 10 will now be described with reference to an exemplary card, the six of spades 12 (see FIGS. 2*a* and 2*b*). The card 12 is provided with a front face 14 imprinted with a standard design found upon each of the cards in the set. The front face 14 may be printed with traditional ink or the front face 14 may be printed with luminescent ink that may, or may not, utilize the dual imaging discussed below in greater detail below.

The card 12 also includes a back face 16 imprinted with the designation of a specific card. For example, the card 12 shown in FIGS. 2*a* and 2*b* designates the six of spades. The back face 16 of the card is imprinted with both traditional ink 18 and luminescent ink 20 to respectively produce a first image 22 when the card 12 is viewed under lighted conditions and a second image 24 when the card 12 is viewed in the dark. In accordance with the preferred embodiment of the present invention, the luminescent ink 20 is applied to produce an inverse image of the first image 22 revealed under lighted conditions. Although the second image 24 is an inverse of the first image 22 in accordance with the preferred embodiment of the present invention, the second image may take a variety of forms without departing from the spirit of the present invention.

The luminescent ink 20 is preferably a phosphorescent ink, for example, LumiNova™, Nightlight-20™, or Picariko™. However, any ink which projects an image under non-lighted conditions may be used in accordance with the present invention.

The dual image cards add a new variation to traditional card games by allowing the players to play either under traditional light or in the dark. The cards will also be useful when sufficient light is not available to readily view playing cards, for example, while camping or during a power outage.

While the preferred embodiment has been shown and described, it will be understood that there is no intent to limit the invention by such disclosure, but rather, is intended to cover all modifications and alternate constructions falling within the spirit and scope of the invention as defined in the appended claims.

What is claimed is:

1. A set of playing cards, comprising:

a plurality of cards, wherein each card includes distinct indicia printed thereon, the distinct indicia including a first image viewable under lighted conditions but substantially unseen in the dark and a second image viewable when dark but substantially unseen under lighted conditions, wherein the first image is revealed under lighted conditions and the second image is revealed under non-lighted conditions to offer a playing card with dual images.

2. The set of playing cards according to claim 1, wherein the first image is imprinted with conventional ink.

3. The set of playing cards according to claim 1, wherein the second image is imprinted with luminescent ink.

4. The set of playing cards according to claim 3, wherein the first image is imprinted with conventional ink.

5. The set of playing cards according to claim 3, wherein the second image is imprinted with phosporescent ink.

6. The set of playing cards according to claim 1, wherein the set of playing cards includes fifty-two cards.

7. The set of playing cards according to claim 1, the second image is the inverse of the first image.

8. The set of playing cards according to claim 1, wherein each card includes a front face imprinted with a standard design found upon each of the cards found in the set and a second face upon which the first image and the second image are imprinted.

9. The set of playing cards according to claim 8, wherein the second image is imprinted with luminescent ink.

10. The set of playing cards according to claim 9, wherein the first image is imprinted with conventional ink.

* * * * *